US005201190A

United States Patent [19]

Nelson et al.

[11] Patent Number: 5,201,190

[45] Date of Patent: Apr. 13, 1993

[54] REFRIGERATOR WITH SUBCOOLING FLOW CONTROL VALVE

[75] Inventors: William G. Nelson, St. Cloud, Minn.; Gary R. Peter, Rockford; Sammie C. Beach, Jr., Gowen, both of Mich.

[73] Assignee: White Consolidated Industries, Inc., Cleveland, Ohio

[21] Appl. No.: 837,011

[22] Filed: Feb. 24, 1992

[51] Int. Cl.[5] ..... F25B 41/04

[52] U.S. Cl. ..... 62/210; 62/229; 62/513

[58] Field of Search ..... 62/511, 513, 113, 204, 62/205, 229, 216, 222, 208, 209, 210; 251/368

[56] References Cited

U.S. PATENT DOCUMENTS

| | | | |
|---|---|---|---|
| 2,077,865 | 4/1937 | Wile | 62/513 X |
| 3,438,391 | 4/1969 | Yocum | 251/368 X |
| 3,638,446 | 2/1972 | Palmer | 62/209 X |
| 4,840,038 | 6/1989 | Sato | 62/210 |
| 4,848,098 | 7/1989 | Kuijpers et al. | 62/511 |

*Primary Examiner*—Harry B. Tanner

*Attorney, Agent, or Firm*—Pearne, Gordon, McCoy & Granger

[57] ABSTRACT

A household type refrigerator has a refrigeration system including a subcooling flow control valve placed between the outlet of the condenser and the inlet to the capillary tube. The subcooling flow control valve utilizes a sealed capsule of refrigerant which operates to open and close a valve to modulate the flow from the condenser to the capillary tube to insure only that a subcooled liquid enters the capillary. The valve is mounted vertically next to the compressor and has the inlet line to the valve secured in heat conducting contact to the return line to the compressor for faster opening and closing response while the discharge side of the valve has a chamber filled with a plug to minimize the volume of refrigerant remaining between the closed valve and the entrance to the capillary when the compressor is on the off cycle.

8 Claims, 3 Drawing Sheets

REFRIGERATOR WITH SUBCOOLING FLOW CONTROL VALVE

BACKGROUND OF THE INVENTION

This invention relates generally to refrigeration systems for household refrigerators and freezers, and more particularly to such systems employing a subcooling flow control valve to control flow of refrigerant between the condenser and evaporator for maximum energy efficiency.

Household refrigerators and freezers nave been the subject of increasingly strict legal regulations regarding the energy efficiency of these units, and this has required the extensive redesign of these units to meet these regulations. While some of the improvement in efficiency has been obtained by improvements in the cabinet insulation, it has been found that the greatest improvement can be had in the refrigeration system itself. Considerable increases in efficiency have been made in the compressors as well as the sizing of the condensers and evaporators, but the latter tend to provide a peak efficiency at one certain set of operating conditions, such as ambient temperature, door openings, and type and size of the contents stored in the unit.

Recently it has been found that further increases in efficiency can be obtained by the addition of a subcooling flow control valve positioned between the outlet of the condenser and the inlet to the capillary tube that provides the necessary restriction and pressure drop at the entrance to the evaporator. The flow control valve functions in two ways to increase efficiency of the system. First, when the compressor is running, the valve operates in a modulating manner to allow only subcooled liquid to enter the capillary and thereby prevent any vapor from entering. Second, when the compressor stops, the valve closes to prevent any refrigerant from flowing in either direction while the compressor is not running, and the valve then must quickly reopen when the compressor restarts.

The valve is operated by a sealed capsule of a saturated refrigerant which expands and contracts in response to the amount of subcooling of the refrigerant leaving the condenser and entering the capillary tube to insure that only subcooled liquid refrigerant enters the capillary. If the temperature of the refrigerant rises above a predetermined point set below the saturation temperature, the valve closes to prevent flow in either direction between the condenser and the capillary. Such a system and valve has been disclosed in the copending patent application of J. D. Powlas, Ser. No. 671,390, filed Mar. 19, 1991, and assigned to the assignee of the present application. However, that system and valve have been found sometimes to operate in a somewhat unstable manner under certain conditions and the valve has been somewhat slow to open and close when the compressor is started and stopped. Furthermore, it has been observed that sometimes the valve has reopened after the initial closing after the compressor has stopped. If the valve reopens, the pressure equalizes across the valve and there is a significant loss of system energy efficiency. Thus it is desirable to insure a rapid response to opening and closing conditions and to insure that the valve will remain closed while the compressor is off.

SUMMARY OF THE INVENTION

According to one aspect of the present invention, it has been found that the flow control valve operates with a faster response time on both opening and closing if it is positioned near the compressor and the refrigerant return line to the compressor. The valve is placed in a vertical position with the tubing at the inlet to the valve extending for a short distance parallel to the return line to the compressor. The two tubes are placed in a heat transferring relationship by contact. According to one embodiment of the invention, this may be done by soldering the tubes together along the length of contact. According to another embodiment of the invention, this may be done by using a spring clip which fits over the two tubes and not only holds them in contact, but also serves to conduct heat between the two tubes. It has been found that the zone of heat conducting contact should be as close to both the compressor and the valve body as possible.

According to another aspect of this invention, it has been found that the problem of the valve reopening after it has initially closed when the compressor has stopped is caused by the evaporation of liquid refrigerant in the valve body cooling the valve to a temperature below the set point below which the valve will open. It has been found that with the present valve, this cooling results from the volume of refrigerant on the outlet side of the valve at the entrance to the capillary tube. This volume can be substantially eliminated either by placing a filler plug within the valve housing at the outlet side of the valve orifice or by reshaping the valve housing itself to reduce this space. The resulting valve does not have a sufficient volume of refrigerant at this point to cause enough cooling upon evaporation to cool the valve and the valve capsule below the set point where it will begin to reopen, and the valve will therefore remain closed until the compressor restarts.

DESCRIPTION OF THE PREFERRED EMBODIMENTS

Figure 1:
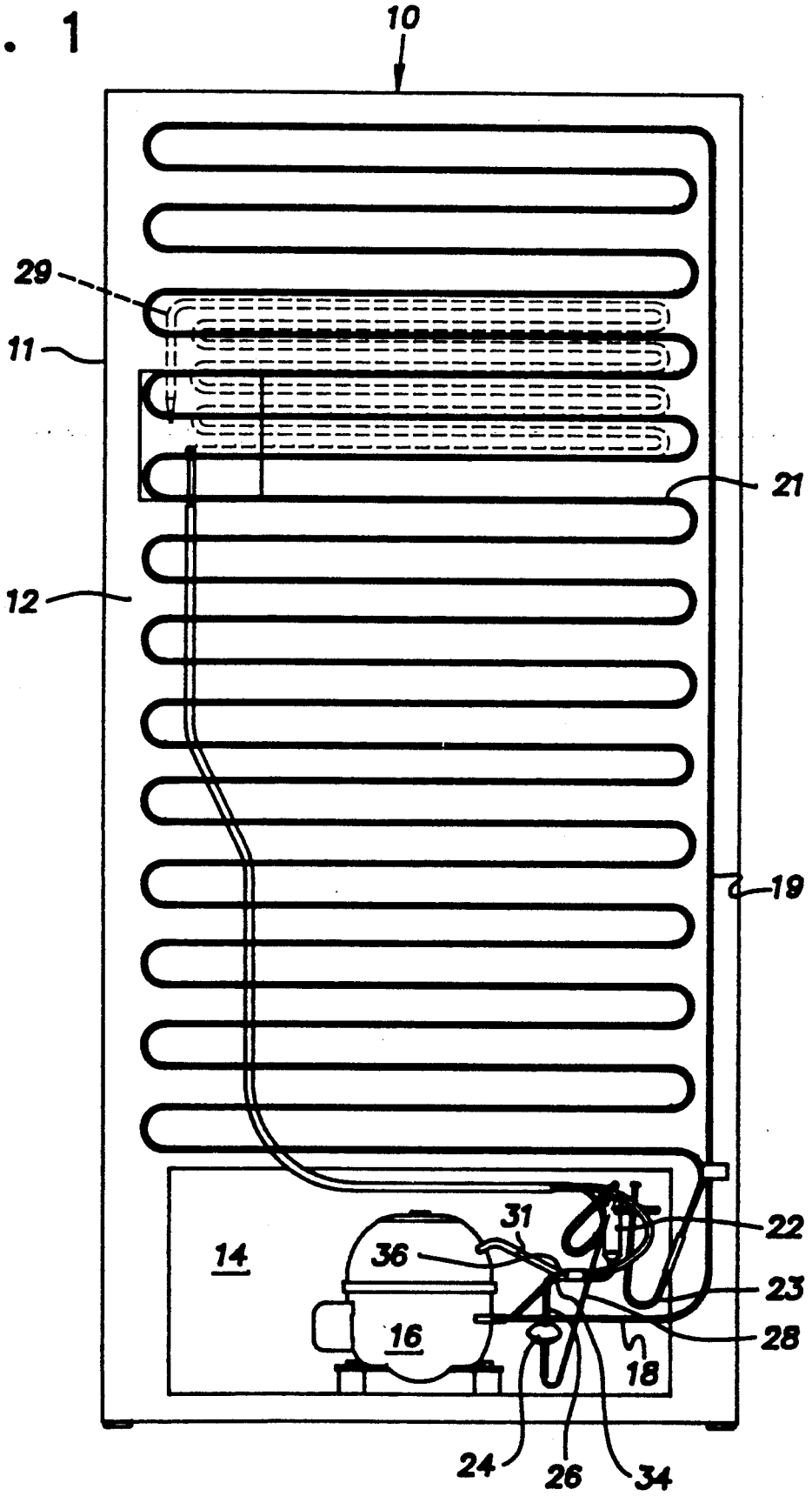
FIG. 1 is a rear elevational view of a refrigerator incorporating a preferred embodiment of the invention.

Referring now to the drawings in greater detail, FIG. 1 shows the back of a refrigerator 10 incorporating the present invention. Refrigerator 10 includes a cabinet 11 having a back panel 12 having an opening at the lower end exposing the machine compartment 14 within which is mounted a compressor 16 and other components of the refrigeration system. Compressor 16 includes an outlet line 18 which in turn connects to a vertical line 19 extending upwardly along the back panel 12 to the upper end of a serpentine tubing condenser 21 which is suitably mounted a spaced distance away from the back panel 12 to allow adequate air circulation and heat transfer.

Figure 2:
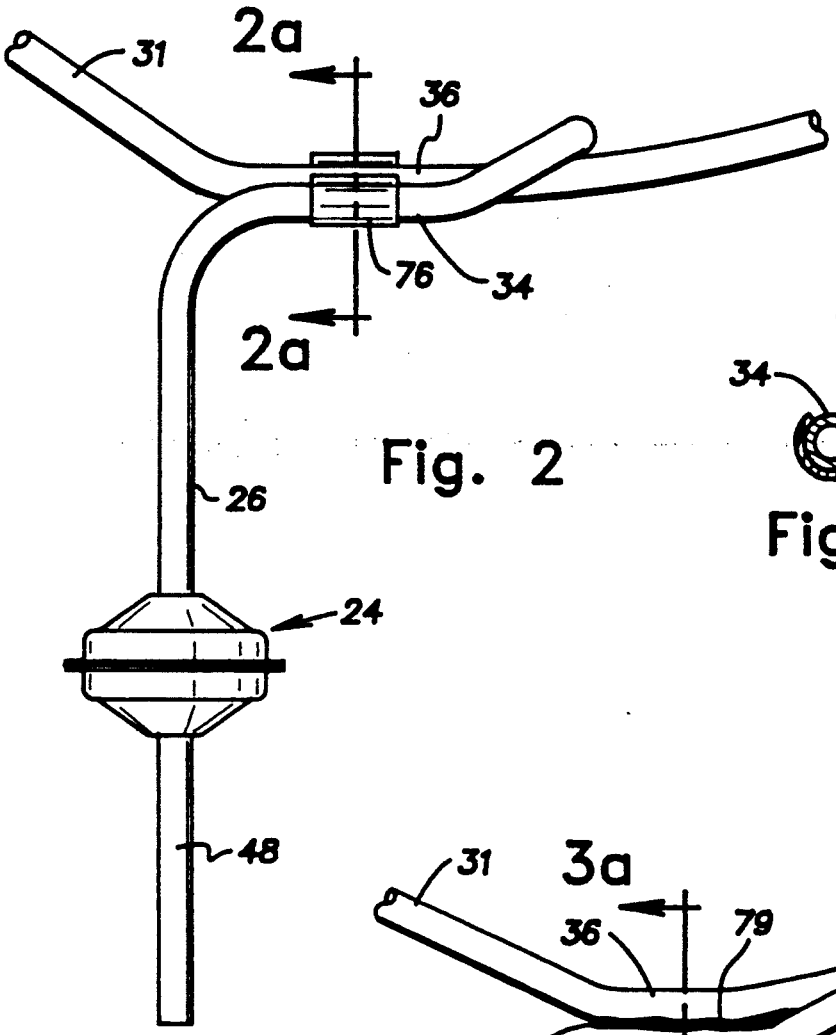
FIG. 2 is a fragmentary elevational view of the mounting of the flow control valve according to one embodiment of the invention.
Figure 2A:
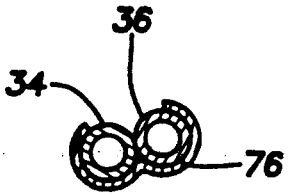
FIG. 2*a* is a cross-sectional view taken along line 2*a*—2*a* of FIG. 2.
Figure 3A:
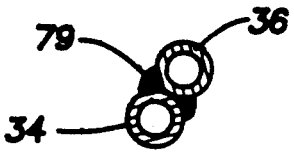
FIG. 3*a* is a cross-sectional view taken along line 3*a*—3*a* of FIG. 3.
Figure 3:
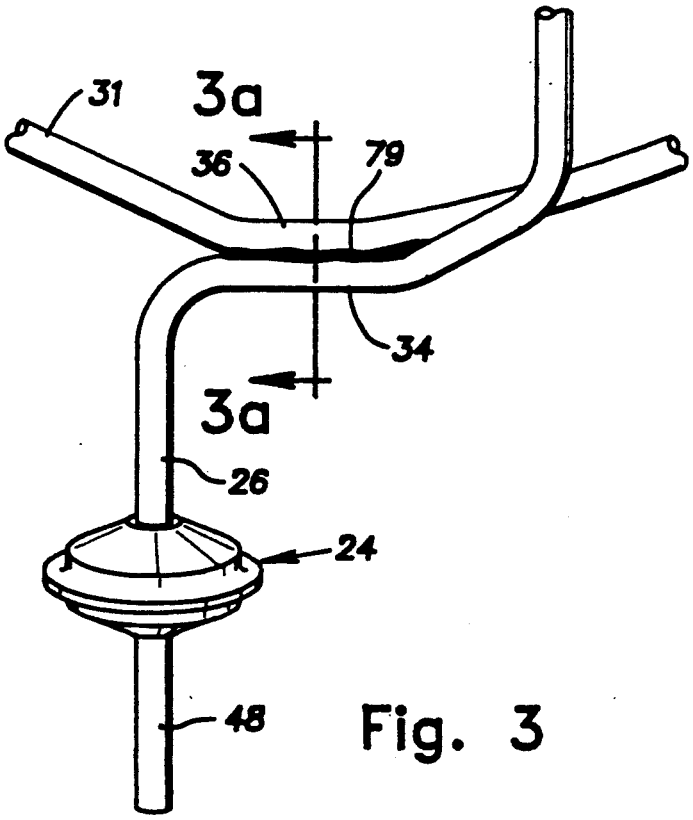
FIG.3 is a fragmentary elevational view similar to FIG. 2 according to another embodiment of the invention.

At the bottom of the condenser 21, the refrigerant is conducted through a connecting tube 23 to a dryer cartridge 22 and the outlet from the dryer cartridge 22 is connected through a line 26 to a flow control valve 24 which is preferably constructed as shown hereafter. The outlet of the flow control valve 24 is connected to a capillary tube 28 which extends upwardly to the evaporator 29 mounted within the cabinet 11 and generally extends in heat conducting relationship with the return line 31 which extends from the outlet of the evaporator 29 back to the compressor 16. As shown in FIGS. 2 and 3, a portion 34 of line 26 between the dryer and the flow control valve extends parallel to and in abutting contact with a portion 36 of the return line 31 close to the compressor 16. It has been found that by allowing heat transfer between the portions 34 and 36, response of the flow control valve 24 is improved by the heat transfer on both the starting and the stopping of the compressor. Thus, when the compressor is turned off, the hot compressor conducts heat back through the return line to tend to warm up the flow control valve and thus, bias it to a closed position. On the other hand, when the compressor is started, the immediate pressure drop in the return line causes the temperature to drop, thereby tending to cool the flow control valve by cooling the refrigerant entering the valve so that it will open more quickly and allow flow through the entire system with a minimum of delay after the compressor starts.

Figure 4:
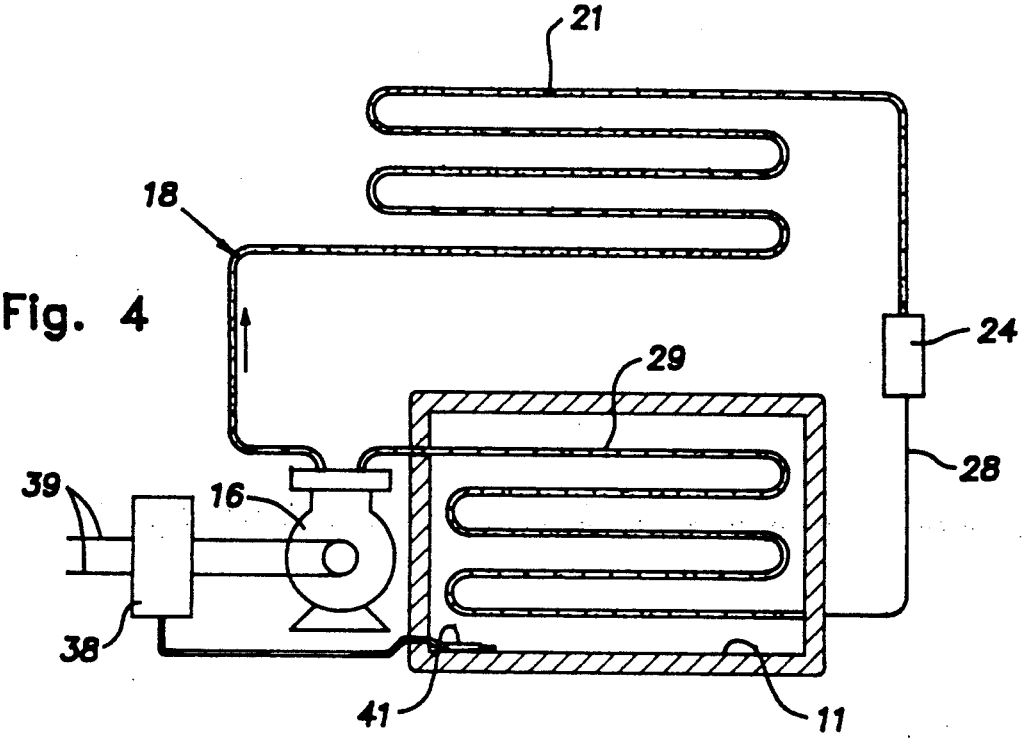
FIG. 4 is a schematic representation of the refrigeration system of the refrigerator of FIGS. 1-3; and, FIG. 5 is an enlarged vertical cross-sectional view of the flow control valve according to the invention.

The operation of the system can also be seen from the schematic diagram of FIG. 4 showing the flow of refrigerant from a compressor 16 through an outlet line 18 to the condenser 21 and from there to the flow control valve 24 to the capillary tube 28 and evaporator 29 mounted within the cabinet 11. The return line 31 then connects the evaporator 29 back to the compressor 16. As shown, the compressor 16 is driven by a suitable electric motor 38 which is mounted within the shell of the hermetic compressor shown in FIG. 1 and power is supplied through electric lines 39. The motor 38 in turn is controlled through a thermostat 41 sensing the temperature within the cabinet 11 and designed to turn the motor 38 on and off to maintain the temperature within a fixed range within the cabinet.

Figure 5:
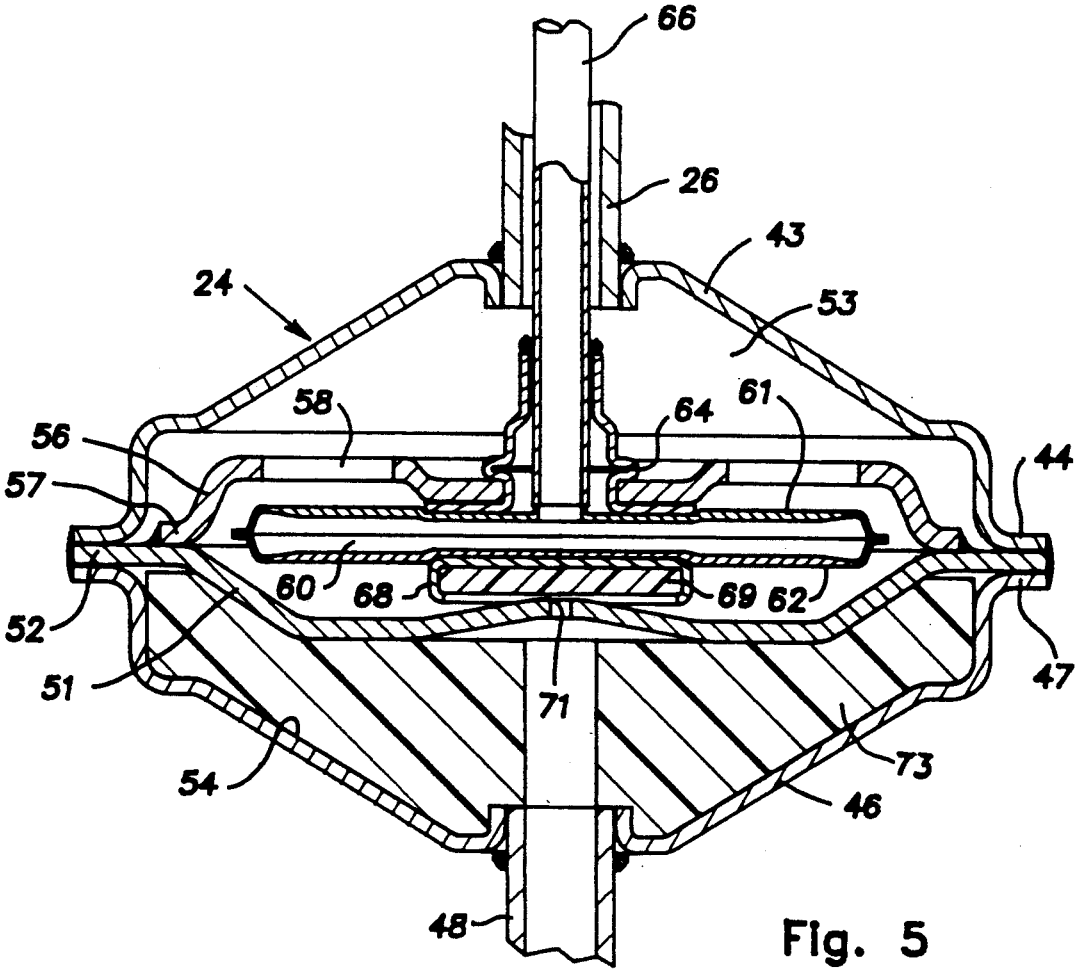

The flow control valve 24 is shown in detail in FIG. 5 and generally corresponds to the valve shown in the aforesaid application of J.D. Powlas, Ser. No. 671,390, filed Mar. 19, 1991, which is incorporated by reference herein. The valve includes upper and lower housing members 43 and 46 in the form of opposed cup-shaped members having flanges 44 and 47, respectively, which are secured together around the edges on either side of a flange 52 on a center partition member 51 extending transversely across the interior of the housings 43 and 46 to divide the interior into an upper chamber 53 and lower chamber 54. At the center of the upper housing 43 is a fitting to receive the line 26 from the dryer cartridge 22 while the lower housing 46 has a fitting to receive an outlet tube shown at 48 to which is connected the capillary tube 28 (not shown).

Within the upper chamber 53 is located a support member or plate 56 extending transversely across the chamber a spaced distance from the partition member 51 to which it is rigidly secured at a peripheral flange 57. The support member 56 includes a number of openings 58 to allow refrigerant to flow freely through the support member to a point adjacent the partition member 51. Within the space between support member 56 and partition member 51 is located an assembly comprising upper and lower diaphragm members 61 and 62 Which form a sealed chamber 60. The upper diaphragm 61 is rigidly secured to a fitting 64 which in turn is rigidly mounted on the support member 56 and connected to a tube 66 which forms part of chamber 60 and extends upward into the inlet line 26 for a spaced distance to allow heat transfer between the fluids within the chamber 53 and within the sealed chamber 60. The lower diaphragm member 62 carries on its central portion a rigidly secured cup 68 which carries an elastomeric valve seal 69 adapted to make valving contact with a valve seat opening 71 formed at the center of the partition member 51.

While the chambers 53 and 54 contain the refrigerant filling charge of the system, the chamber 60 including the interior of tube 66 is sealed off from the system refrigerant and filled with a saturated charge of a refrigerant that may be the same as the system refrigerant or be one having a higher vapor pressure at the same temperature under saturated conditions. The volume of the saturated refrigerant within the chamber 60 is carefully calibrated to insure the opening and closing of the valve by movement of the lower diaphragm member 62 and hence, the valve seal 67 toward and away from the valve seat 71. Thus, the charge is sufficient that the valve is normally closed until the pressure and temperature within the chamber 53 and hence chamber 60 reaches a set point below the subcooling conditions to ensure that the chamber 53 is filled with a subcooled liquid from the condenser. Under these conditions of subcooling, the refrigerant within the chamber 60 will be compressed to allow the lower diaphragm member 62 to move upwards to move the valve seal 69 away from seat 71. When this is done, the valve is opened and refrigerant can now pass into the capillary 28 and evaporator 29 to cool the cabinet 11. Thus, as long as a compressor 16 is running, the flow control valve 24 operates in modulating manner to insure that only a subcooled liquid is allowed to enter the capillary tube 28. Thus, as the amount of subcooling among the chamber 53 increases, the valve seal 69 will move farther away from valve seat 71 to allow increased fluid flow into the capillary, while a decrease in the amount of subcooling still below the set point causes the valve seal 69 to move closer to the valve seat 71 to provide additional throttling and decreased flow into the capillary tube.

When the compressor 16 is turned off as a result of the control signal from the thermostat 41 indicating that the chamber of the cabinet 61 is now at its lowest temperature, there is no further flow into the condenser 21 with the result that the subcooling in the chamber 53 is reduced and eventually result in a condition where vapor is present at the outlet of the condenser. In the absence of the flow control valve 24, that vapor would then enter the capillary and hence the evaporator 29 causing a heating effect that would counteract some of the earlier cooling. To prevent that, the flow control valve closes once the subcooling is reduced below the set point, and the valve seal 69 moves into sealing engagement with the valve seat 71 to prevent any flow of refrigerant from the condenser into the capillary tube. By maintaining the valve closed while the compressor is off, there is no heat transfer into the evaporator resulting from gas flow through the capillary and there tends to be a residual amount of liquid in the condenser so that a subcooling condition can be re-established fairly quickly after compressor restart to allow the flow control valve to open. However, it is important that the valve not reopen while the compressor is on the off cycle. Under certain conditions, it has been found that the valve may reopen with a consequent loss of efficiency and it is believed that one of the reasons for this is the presence of a large amount of refrigerant in liquid form in the chamber 54. It has been found that after the compressor is stopped and the valve closes, the liquid refrigerant in chamber 54 gradually vaporizes as a result of additional flow through the capillary tube from the existing pressure differential. The change of phase of this refrigerant in chamber 54 turning into gas results in a cooling that tends to absorb heat from the other side of the partition member 51 to the point where the conditions in the diaphragm chamber 60 result in sufficient subcooling of that refrigerant that the valve may reopen. Once that happens on the off cycle, the valve will not reclose and the flow control valve fails to prevent heat transfer to the evaporator.

To overcome this problem, it has been found that reopening of the valve can be prevented effectively by reducing the volume of the lower chamber 54 to an absolute minimum. This may be done by substantially filling the chamber with a plug 73 which may be formed of any suitable plastic material such as nylon, and by shortening the length of the outlet tube 48 to bring the entrance to the capillary tube 28 as close to the valve seat opening 71 as possible. Of course, the volume may also be reduced by reshaping the lower housing 46 to minimize the volume of the chamber.

To further prevent reopening of the valve when the compressor is off, as well as to increase the response time for the valve to reopen after the compressor is restarted, it has been found desirable to mount the flow control valve 24 in a position adjacent the compressor 16 (FIG. 1) and actually place the inlet line to the flow control valve 26 in heat exchange contact with the compressor return line 31 from the evaporator. Since the flow control valve 24 should be mounted in a vertical position with the inlet line 26 and outlet tube 48 arranged along a vertical axis, the upper end of the line 26 is preferably bent at an angle to extend for a short distance to be parallel to the return line 31 as close to the compressor as possible so that the length of the return line 31 between the line 26 and the compressor itself is at a minimum. To aid in the heat conducting contact, the tubes are held in abutting contact by means of a metal clip as shown in FIG. 2. The metal clip is preferably made of a flat band of spring steel 76 extending around the tubes and in abutting contact so that heat transfer is obtained between the two tubes not only by their abutting contact but also through the clip itself which extends around a substantial portion of the periphery of each of the tubes.

An alternative arrangement is shown in FIG. 3 wherein the absence of a clip 76, a bead of solder 79 is secured to both of the tubes not only to hold them in abutting contact but also to provide heat transfer through the solder bead itself.

By providing heat transfer between the return line 31 and the line 26 leading to the flow control valve 24, improved performance of the flow control valve 24 is provided on both starting and stopping of the compressor 16. When the compressor is turned off, cooling of the flow control valve 24 and the chamber 60 is further prevented by heat transfer from the compressor, which is relatively hot, back through the return line 31 to the inlet tube 26. Since the tube 66 within the tube 26 forms an extension of the chamber 60, the line 26 tends to quickly warm up from heat transfer from the return line 31 and this in turn allows heat to be added to the refrigerant within the chamber 60 and tube 66 to ensure that the valve 24 remains positively closed as long as the compressor is off. When the compressor is restarted, the return line 31 tends to cool at once as the pressure within it is reduced because of the suction in the compressor. This cooling in the return line 31 thus absorbs heat from the line 26 causing further cooling in the chamber 60 and tube 66 to insure rapid opening of the valve as a subcooling condition is created with the inflow of refrigerant from the condenser 21.

As a result of these provisions, the flow control valve 24 operates more rapidly and in a more positive manner not only by opening and closing promptly with the starting and stopping of the compressor, but also in avoiding any possible reopening during the off cycle which would result in a loss of efficiency for the system.

Although several preferred embodiments of the invention have been shown and described in detail, it is recognized that various modifications and rearrangements may be resorted to without departing from the scope of the invention as defined in the claims.

What we claim is:

1. A refrigerated cabinet comprising a compartment, a compressor, a condenser, an evaporator in said compartment, a capillary tube connecting said condenser and said evaporator in a closed circuit containing a first refrigerant, said circuit including a return line from said evaporator to said compressor, a thermostat responsive to the temperature in said compartment for selectively energizing said compressor to maintain the temperature in said compartment within a predetermined range, a subcooling flow control valve between said condenser and said capillary tube, said flow control valve having a housing, an inlet tube to said housing connected to said condenser, an outlet tube from said housing to said capillary tube, said flow control valve being operable when the subcooling of the refrigerant at said inlet tube is greater than a predetermined amount to open said valve and permit flow of refrigerant from said condenser into said capillary tube and when the subcooling of said refrigerant in said first chamber is less than said predetermined amount to close said valve and prevent flow of refrigerant into said capillary tube, said flow control valve housing being positioned on said cabinet adjacent said compressor with said inlet tube in heat conducting contact with said return line so that said compressor absorbs heat from said valve when said compressor starts and transfers heat to said valve when said compressor stops.

2. A refrigerated cabinet as set forth in claim 1, including heat conducting means secured to both said tube and said return line.

3. A refrigerated cabinet as set forth in claim 2, wherein said heat conducting means is a metal clip extending over said tube and said return line.

4. A refrigerated cabinet as set forth in claim 2, wherein said heat conducting means is a soldered joint.

5. A refrigerated cabinet comprising a compartment, a compressor, a condenser, an evaporator in said compartment, a capillary tube having an outlet connected to said evaporator and an inlet connected to said condenser in a closed circuit containing a first refrigerant, a thermostat responsive to the temperature in said compartment for selectively energizing said compressor to maintain the temperature in said compartment within a predetermined range, a flow control valve between said condenser and said inlet to said capillary tube, said flow control valve having a housing defining a first chamber, an inlet to said first chamber connected to said condenser, an outlet from said first chamber to said capillary tube, a valve seat on said housing at said outlet, a movable wall member within said first chamber defining a second chamber, said movable wall member being secured to said housing, a valve member operable by movement of said movable wall member to move to and from said valve seat, said second chamber being filled with a predetermined saturated charge of a second refrigerant whereby said valve member is spaced from said valve seat when the subcooling of said first refrigerant in said first chamber is greater than a predetermined amount and said valve member is moved into engagement with said valve seat when the subcooling of said refrigerant in said first chamber is less than said predetermined amount, engagement of said valve member with said valve seat preventing any flow of said first refrigerant from said inlet to said outlet, the volume of refrigerant in the space between said valve seat and said capillary tube inlet being sufficiently small that evaporation of said refrigerant volume will not cool said second chamber to permit said valve member to move away from said valve seat and reopen the closed valve.

6. A refrigerated cabinet as set forth in claim 5, wherein said space between said valve seat and said capillary tube inlet defines a third chamber and said third chamber is substantially filled by an inert member.

7. A refrigerated cabinet as set forth in claim 6, wherein said inert member is a plastic plug.

8. A refrigerated cabinet as set forth in claim 7, wherein said plastic is nylon.

* * * * *